United States Patent [19]

Beavers

[11] 4,146,114

[45] Mar. 27, 1979

[54] MANHOLE SHIELD LADDER

[75] Inventor: Allan E. Beavers, Littleton, Colo.

[73] Assignee: T. A. Pelsue Company, Englewood, Colo.

[21] Appl. No.: 907,047

[22] Filed: May 18, 1978

[51] Int. Cl.[2] ..... E06C 1/36; E06C 7/48

[52] U.S. Cl. ..... 182/206; 182/194; 182/106; 248/215

[58] Field of Search ..... 182/206, 150, 93, 60, 182/61, 57, 194, 106; 248/215, 226.1

[56] References Cited

U.S. PATENT DOCUMENTS

| | | | |
|---|---|---|---|
| 2,843,393 | 7/1958 | Dahlander | 182/206 |
| 2,854,292 | 9/1958 | Schaeffer | 182/206 |
| 3,078,955 | 2/1963 | Rich | 182/206 |
| 3,120,290 | 2/1964 | Kamrath | 182/206 |
| 3,869,742 | 3/1975 | Gale | 182/206 |

*Primary Examiner*—Reinaldo P. Machado
*Attorney, Agent, or Firm*—Edwin L. Spangler, Jr.

[57] ABSTRACT

This invention relates to a specialized ladder for use with a ring-like shield bordering the entryway into a manhole, said ladder being characterized by hook-forming subassemblies depending from the right and left handrails adapted to releasably hook over the upwardly-facing rim of the shield, each such hook subassembly including a hanger member projecting out over the shield rim in overhanging relation to the latter, a downwardly and inwardly inclined tubular slide on the overhanging end of the hanger member and a self-locking latch pin mounted within said slide for automatic free-sliding gravitational movement therein from a retracted unlocked position out of contact with the cylindrical shield wall into an extended latched position resting thereagainst. The ladder also includes a horizontally-disposed stop pin projecting from each handrail cooperating with one or the other of a pair of vertically-disposed pins hanging down from the underside of the hanger member in radially-spaced relation to simultaneously engage the upper rim-encircling flange of the shield and cylindrical inside wall thereof so as to maintain said ladder in a stable more or less vertical position closely adjacent the wall of the entryway.

7 Claims, 4 Drawing Figures

MANHOLE SHIELD LADDER

Working in underground installations accessed through a manhole in the surface has been responsible for a number of injuries, some of them serious. The usual cause of these injuries is the fact that the ladder used for purposes of ingress and egress tilts over backward with a workman aboard thus throwing him off or causing his body to strike the opposite edge of the manhole rim, wall or whatever surface lies behind him. The reason for these accidents is easily explained, namely, the fact that the ladders must be stood on end in nearly vertical position to leave enough room for the workman's body to pass between it and the opposite edge of the manhole. While some attempts have, undoubtedly, been made to secure the upper end of the ladder to the ring-like seat bordering the entryway that supports the lid used to cover the opening, these efforts have, apparently, proven unsuccessful since accidents of this type continue to occur.

It has now been found in accordance with the teaching of the instant invention that such accidents caused by an access ladder tipping over backwards can be eliminated by the simple, yet unobvious, expedient of rimming the open manhole with a shield of the type forming the subject matter of U.S. Pat. No. 3,294,000 and then employing the latter as the surface support from which the novel ladder of the instant invention can be hung in essentially vertical, but untippable, position. The handrails project well above the top of the shield where they can be grasped and held onto as the workman steps backward over the edge of the shield and places his foot on the top step. Coacting stops engaging the inner cylindrical surface of the shield and the outer circumferential edge of a rim-encircling flange on its upper edge cooperate with one another under the influence of the workman's weight tending to tilt it over backwards to maintain it tightly and immovably secured to the shield. The hook-forming subassemblies that depend from the handrails and hook over the rim of the shield offer no obstruction to a person using the ladder, in fact, in the preferred form of the invention, they are arranged in divergent relation. Two such flange-engaging stops are provided, one to engage the rim-encircling flange on the small end of the shield and a second to engage a like flange on the large end.

As an added safety feature, each hook-subassembly includes a self-locking latch pin which will gravitate by itself from a retracted unlocked position out of contact with the shield downwardly and inwardly into engagement therewith at a point thereon essentially opposite the wall-engaging stop.

It is, therefore, the principal object of the present invention to provide a novel and improved ladder for use in combination with a manhole shield to gain safe ingress and egress to an underground installation through a manhole.

A second objective is the provision of a ladder of the type described which is completely portable and can be easily and quickly removed when not needed.

Another object is to provide a combination ladder and manhole shield that provides minimal obstruction of the entryway.

Still another objective is the provision of a ladder of the kind herein disclosed and claimed which need only be lowered over the edge of the shield while holdling on to the latch elements for it to swing into proper position and lock all by itself.

An additional object is to provide a ladder unit which works equally well with either end of a double-ended reversible manhole shield of the type designed to accommodate two different sized manholes.

Further objects are to provide a ladder for use with a manhole shield that is simple, compact, rugged, lightweight, versatile, strong, easy to operate, safe, trouble-free, and even decorative in appearance.

Other objects will be in part apparent and in part pointed out specifically hereinafter in connection with the description of the drawings that follows, and in which.

Figure 2:
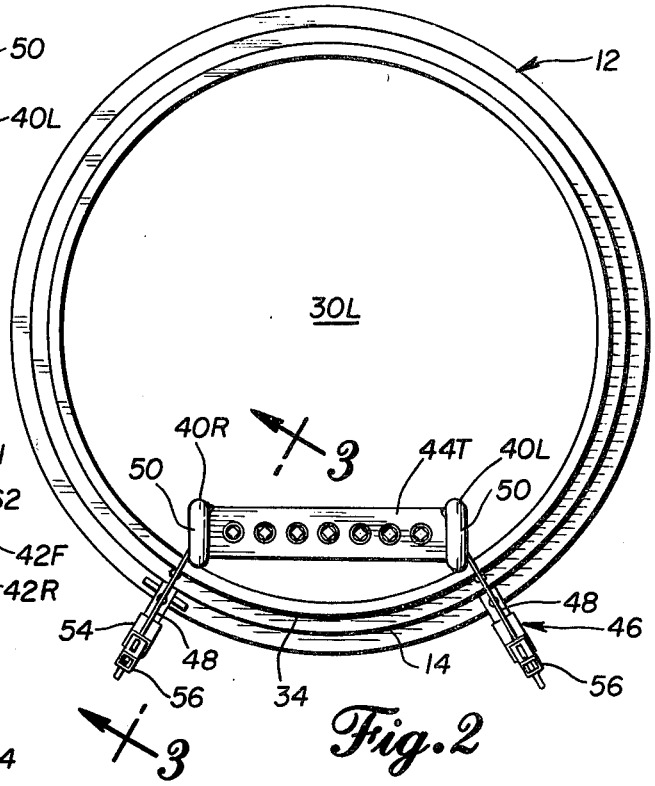
FIG. 2 is a top plan view to a slightly reduced scale showing the ladder being in place over the rim of a manhole shield.
Figure 3:
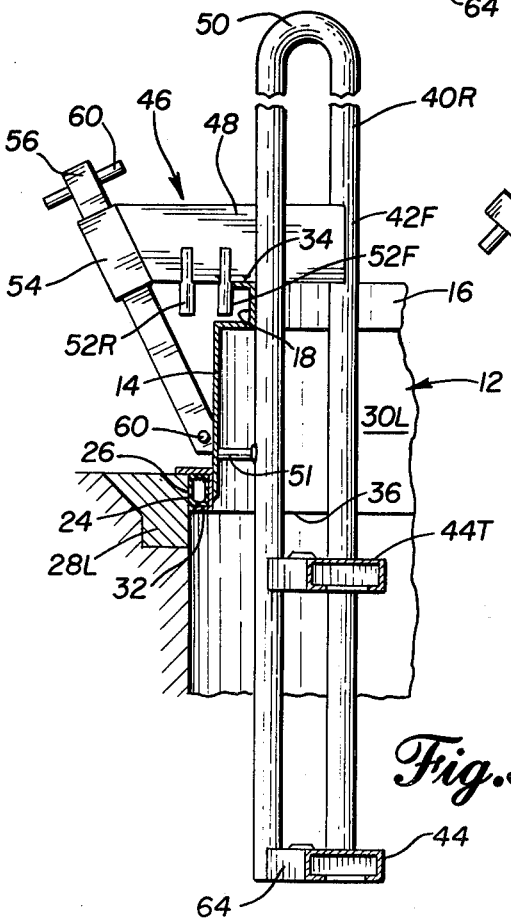
Figure 4:
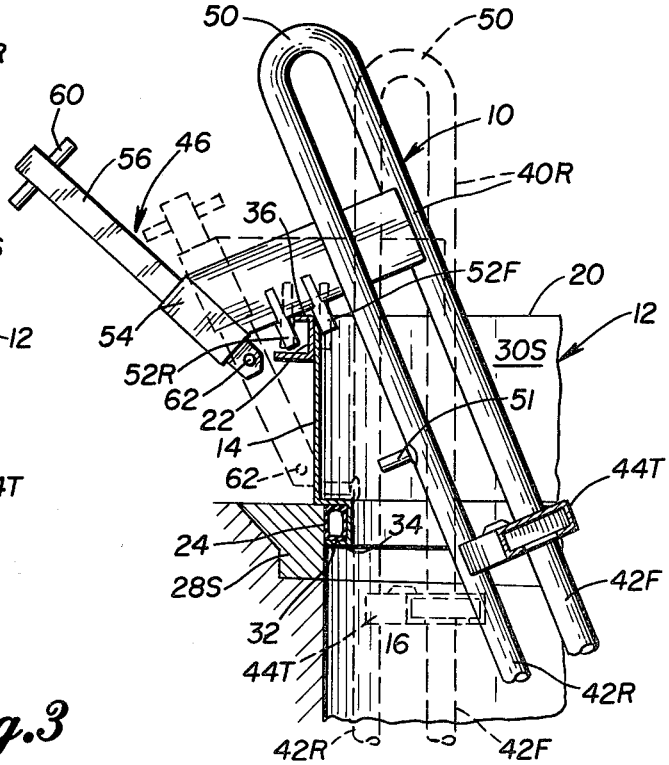

FIG. 3 is a section to an enlarged scale taken along line 3—3 of FIG. 2, portions of the handrails having been broken away to conserve space; and, FIG. 4 is a section somewhat analogous to FIG. 3, but differing therefrom in that the ladder is shown in engagement with the rim-encircling flange bordering the large rather than the small end of the shield and, in addition, the ladder is shown in full lines with its latch pins retracted being tilted into operative position and in broken lines in the seated position of FIG. 3.

Referring next to the drawings for a detailed description of the present invention, the ladder has been broadly designated by reference numeral 10 while the shield used in combination therewith has been similarly referred to by numeral 12. A description of the ladder and its function will, it is thought, be facilitated by first outlining the essential features of the shield 12 for which purpose reference will be made initially to FIGS. 2, 3 and 4.

The shield shown is more fully described in the previously identified U.S. patent directed thereto; however, certain salient features thereof are worthy of mention here. It consists basically of a cylindrical wall 14 bordered on one end 16 by a recessed outwardly-facing annular groove 18 and on the other end 20 by a similar outwardly-facing annular groove 22 that encircles the cylindrical wall on the outside thereof. These annular grooves 18 and 22 are each adapted to receive an inflatable tubular seal 24 (bicycle tire tube) which, upon inflation, forms an essentially fluid-tight seal against the cylindrical wall 26 of the cast iron ring 28 that borders a conventional manhole 30. These rings also provide an upwardly-facing but recessed ledge 32 atop which one of the rim-encircling marginal flanges 34 or 36 rest. The elements of the shield that cooperate with the last mentioned flanges to define the annular grooves 18 and 22 are of no significance to the present description and, therefore, will not be discussed.

Next, in FIGS. 2 and 3, the shield 12 is shown disposed large end (20) down within the large size manhole 30L bordered by the large diameter ring 28L. On the other hand, FIG. 4 shows the same shield 12 disposed small end (16) down within a small size manhole 30S bordered by small diameter ring 28S. Illustrating the shield in this manner makes it possible to show most clearly the versatility of the ladder soon to be described since it accommodates the shield both ways, i.e. small end up as well as large end up. It is important to realize, however, that while the ladder can be used most advantageously with the patented shield shown, it is by no means limited to use therewith. In fact, as the description of the ladder proceeds, it will become apparent that the ladder of the present invention will function quite satisfactorily with any type of rigid sturdy shield that includes as a part thereof an upstanding ring bordering the entryway into an open manhole.

With this background, reference will be made to all four figures of the drawing for a detailed description of the ladder 10 and how it coacts with the shield 12. In the particular version illustrated, the ladder has a pair of elongate inverted generally U-shaped handrails 40L and 40R arranged in transversely-spaced substantially parallel relation. The front and rear legs 42F and 42L, respectively, of each handrail also lie in spaced substantially parallel relation to receive therebetween the steps 44, two of which have been shown. These steps are spaced one above the other in horizontal position much in the same manner as the rungs of any ladder. From the foregoing, it should be obvious that for purposes of the present description, the front of the ladder is that upon which the user's body is situated while climbing down into the manhole and the rear face thereof is the one nearest the shield 12.

The principal novelty found in the ladder of the present invention resides in the so-called "hook subassembly" which has been designated broadly by reference numeral 46 and which is used to latch said ladder in operative position over the rim of the shield where a person can then use same to climb down into the open manhole 30. This subassembly includes a rearwardly-extending hanger element 48 having its front end attached to a handrail between the upper reversely-bent end 51 of the latter and the top step 44T. From its point of attachment to the handrail, hanger member 48 extends out more or less radially as shown to overhang the rim-encircling flange 34 or 36 bordering the top edge of the shield 12. The preferred essentially radial position of these hangers with respect to the shield they overhang is achieved by welding or otherwise fastening the forward extremity thereof to the inside of front handrail leg 42F and then passing same through the gap between these legs onto the outside of the rear leg 42R where a second welded connection is made. These elements 48 could, of course, be arranged in transversely-spaced parallel, as opposed to divergent, relation to one another by fastening them to either the inside or outside of both siderail legs; however, the relation shown is preferred in that it more perfectly accommodates the two different diameters of flanges 34 and 36 while, at the same time, widening the space between the rear ends thereof through which the user must enter backwards to place his foot on the top step while holding both handrails. These hangers are shown projecting out at right angles to the handrails and, while not critical, there is no particular reason for doing otherwise.

Projecting radially outward from the rear leg 42R of each handrail is a horizontally-disposed wall-engaging stop pin 51 which rests against the inner surface of cylindrical wall 14 of the shield and coacts with one of a pair of vertically-disposed stop pins 52 depending from the underside of the hanger that hooks behind rim-encircling flange 34 or 36 at the top thereof to maintain the ladder in vertical position closely engaging the inside of the open entryway. The innermost of front pin 52F of the pair is positioned to hook over the smaller of the two rim-encircling flanges 34 (FIG. 2) while the outer or rear pin 52R similarly locks behind the outside free edge of the larger one 36 (FIG. 3). The user's weight upon the steps of the ladder together with his unavoidable necessity for pulling forwardly on the handrails functions to tend to rotate the entire assembly clockwise as viewed in FIGS. 3 and 4 thus pressing stop pins 51 and 52 even more tightly against their respective abutments and thereby adding to the stability of the ladder.

Figure 1:
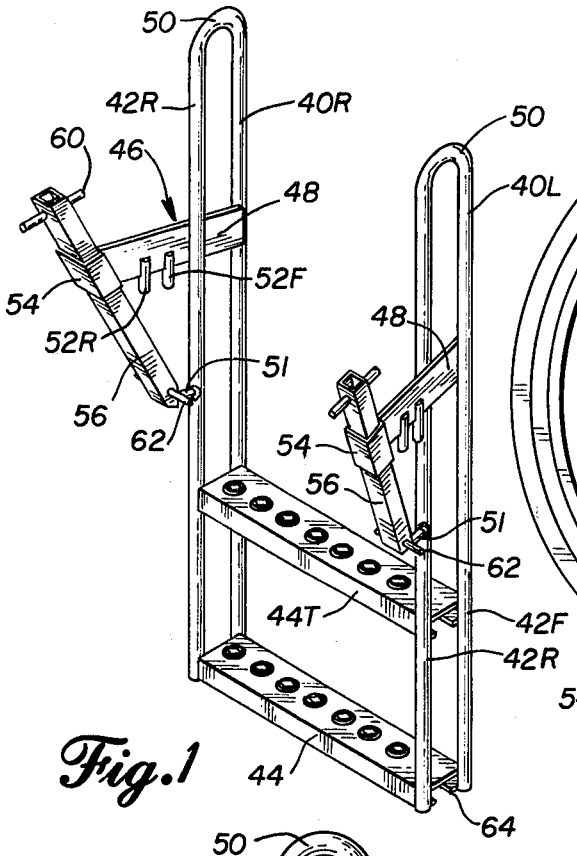
FIG. 1 is a perspective view of the ladder alone.

The remote or free end of the hanger member carries a downwardly and inwardly-inclined tubular slide 54 within which is mounted for slidable movement a self-locking latch pin 56. In the particular form shown, both the latch pin and the slide therefor are rectangular in cross section to prevent relative rotation therebetween. A bias-cut foot 58 at the lower end of this latch pin 56 parallels wall 14 of the shield and engages same, preferably at a point opposite horizontal stop pin 51 when said latch pin is in the extended latched position shown in full lines in FIGS. 1, 2 and 3 and in broken lines in FIG. 4.

FIG. 4, to which reference will now be made shows in full lines how, with the latch pins 58 grasped by their handles 60 and raised into retracted position until the stops 62 on the lower ends thereof engage the slide, the appropriate vertically-disposed stop pin 52 (rear pin 52F as shown) can be hooked outside the corresponding rim-encirciling flange (36); whereupon, the foot 64 (FIGS. 1 and 3) of the ladder need only be tilted into the open manhole and the latch pins released for the assembly to right itself and automatically lock into place (full lines in FIGS. 2 and 3 . . . broken lines in FIG. 4). In other words, once released, the ladder will swing down into vertical position by itself using the free edge of the rim-encircling flange as a fulcrum. At the same time, when the user lets go of the latch pins, they will gravitate automatically into their extended latched positions bearing against the outside of the shield.

What is claimed is:

1. A ladder for use with an upstanding rigid metal ring bordering the entryway into an open manhole which comprises: at least two horizontally-disposed steps arranged in vertically-spaced relation one above another; a pair of vertically-disposed handrails fastened to opposite ends of the steps in transversely-spaced relation; and, a pair of hook-forming subassemblies depending from the handrails for hooking onto the ring, said subassemblies each including a support member positioned and adapted to project out over the upper edge of the ring in overhanging relation to the latter when said handrails are placed in close proximity to the inside thereof, a downwardly and inwardly-directed tubular slide carried by an overhanging portion of the support member, and latch means mounted in said slide for gravitational movement from a retracted position into an extended position engaging the outside of said ring when said hook-forming subassembly is hooked over the latter.

2. The ladder as set forth in claim 1 wherein stop means are provided on opposite ends of said latch means effective to limit the excursion thereof between its retracted and extended positions.

3. The ladder as set forth in claim 1 wherein the support members extend out from the handrails in divergent essentially radial relation with respect to the ring.

4. The ladder as set forth in claim 1 wherein a first ring-engaging stop means is provided on the underside of the support members positioned and adapted to prevent the handrails from moving inwardly away from the ring when hooked over the outside of the latter.

5. The ladder as set forth in claim 1 wherein a second ring-engaging stop means projects from each handrail in position to engage the inside of the ring and maintain said handrails in spaced relation thereto.

6. The ladder as set forth in claim 4 wherein a second ring-engaging stop means depends from each handrail positioned to engage the inside of the ring, said first and second stop means cooperative with one another and with said ring to maintain the handrails in substantially-vertical position therein under the influence of a load tending to tilt said handrails inwardly.

7. The ladder as set forth in claim 5 wherein said second ring-engaging means and latch means cooperate to engage the ring at opposed points on the surface thereof.

* * * * *